US009286816B2

(12) United States Patent
Stanley

(10) Patent No.: US 9,286,816 B2
(45) Date of Patent: Mar. 15, 2016

(54) DISPLAYING DEVICE

(71) Applicant: James Calvin Stanley, Visalia, CA (US)

(72) Inventor: James Calvin Stanley, Visalia, CA (US)

( * ) Notice: Subject to any disclaimer, the term of this patent is extended or adjusted under 35 U.S.C. 154(b) by 0 days.

(21) Appl. No.: 14/447,535

(22) Filed: Jul. 30, 2014

(65) Prior Publication Data

US 2015/0068082 A1 Mar. 12, 2015

Related U.S. Application Data

(63) Continuation-in-part of application No. 29/466,621, filed on Sep. 10, 2013, and a continuation-in-part of application No. 29/487,980, filed on Apr. 14, 2014.

(51) Int. Cl.
*G09F 21/04* (2006.01)
*G09F 7/18* (2006.01)

(52) U.S. Cl.
CPC ..... *G09F 21/04* (2013.01); *G09F 2007/1852* (2013.01); *G09F 2007/1865* (2013.01)

(58) Field of Classification Search
CPC ..... G09F 21/04; G09F 1/10; G09F 3/08; B60Q 1/2615; B60Q 1/302
USPC ..... 40/597; 248/205.5, 181.1, 160, 288.31; 403/90, 76, 141, 142
See application file for complete search history.

(56) References Cited

U.S. PATENT DOCUMENTS 1,823,825 A 9/1931 Edgerton
2,182,275 A 12/1939 Blonvist
2,416,063 A 2/1947 Palmer
2,635,576 A 12/1950 Hodges, Sr.
3,392,950 A 7/1968 Pierce
D234,592 S 3/1975 Callaway
4,673,376 A * 6/1987 Fender ..... 464/158
5,133,141 A 7/1992 Bane
5,187,744 A * 2/1993 Richter ..... 379/449
5,422,078 A 6/1995 Colon
5,566,030 A 10/1996 Yue
5,609,121 A 3/1997 Gross
5,797,696 A 8/1998 Baynes et al.
5,823,432 A 10/1998 Hogan
6,132,051 A 10/2000 Morell et al.
6,140,934 A 10/2000 Lam
6,163,997 A * 12/2000 Deralas ..... 40/745
6,254,836 B1 7/2001 Fry
6,398,378 B1 * 6/2002 Shieh ..... 359/879
6,663,063 B2 12/2003 Tatta
6,708,435 B2 3/2004 Massey
6,823,814 B2 11/2004 Bukky (Continued)

*Primary Examiner* — Cassandra Davis

(57) ABSTRACT

A display device for displaying indicia from a flat surface. The display device includes a flat elongated display panel having a front surface and a back surface. The indicia is displayed on the front surface of the display panel. A round male projection is integrated and extends from the back surface of the flat elongated display panel. A compressible female retaining member is provided and has a concave internal recess adapted to receive the projection within the concave internal recess. A nut fastener is adapted to receive the projection from a first side. The female retaining member is received from an opposite second side of the nut fastener. As the nut fastener is threaded and tightened against the female retaining member, the female retaining member is compressed over the projection to secure the projection within the female retaining member. A flexible arm having a first end is attached to the female retaining member and a second end of the flexible arm is attached to a suction cup fastener.

17 Claims, 5 Drawing Sheets

(56) References Cited

U.S. PATENT DOCUMENTS

| | | | | |
|---|---|---|---|---|
| 7,661,648 | B2 * | 2/2010 | Lin | 248/683 |
| 8,469,325 | B2 * | 6/2013 | Yu | 248/316.1 |
| 2007/0049128 | A1 * | 3/2007 | Brassard | 439/686 |
| 2007/0107278 | A1 | 5/2007 | Norwood | |
| 2007/0243791 | A1 * | 10/2007 | Stedman | 446/227 |
| 2008/0216374 | A1 * | 9/2008 | Ozmun | 40/723 |
| 2009/0072110 | A1 * | 3/2009 | Yu | 248/309.1 |
| 2013/0220847 | A1 * | 8/2013 | Fisher et al. | 206/216 |

* cited by examiner

FIG. 6
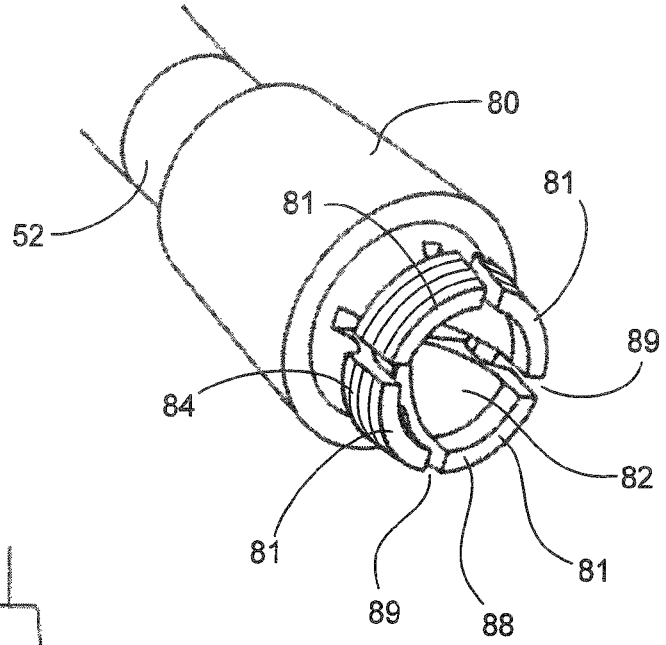
FIG. 7
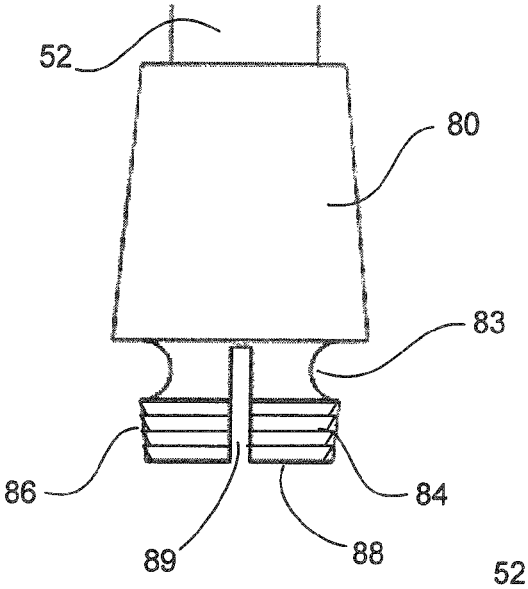
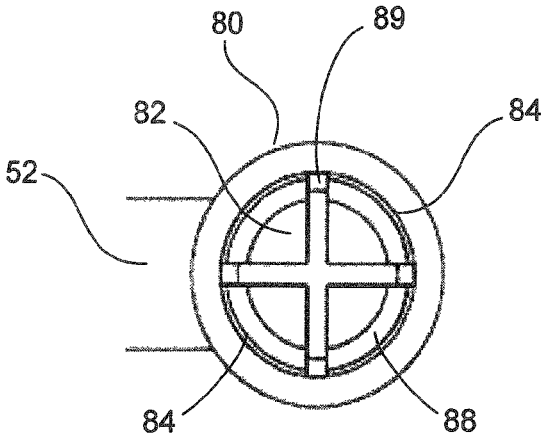
FIG. 8

DISPLAYING DEVICE

CROSS REFERENCE TO RELATED APPLICATIONS

This application is a Non-Provisional Application which claims the benefit of the filing date of: U.S. Application Ser. No. 29/466,621 filed Sep. 10, 2013; and U.S. Application Ser. No. 29/487,980 filed Apr. 14, 2014, the entirety of both applications which is incorporated herein by reference.

BACKGROUND

1. Field

This invention relates in general to providing a hanging display device, and in particular to providing a display device having indicia that is fastened by suction to a flat surface, such as a vehicle window.

2. Description of the Related Art

Conventionally, decals having indicia are placed as flags outside of a vehicle attached to the frame of a window and/or in the corner of a vehicle window so as to prevent the illegal obstruction of a drivers view. The indicia may include a favorite school, motto, vocal band, a professional athletic team, a branch of military, a mascot, a brand, a logo or any other type of desired label displayed by the owner of the vehicle.

SUMMARY

An object of this subject disclosure is to provide a display device having indicia that is fastened to a flat surface, such as a windshield of a vehicle by a suction cup such that the indicia may be displayed from the display device.

In particular, the display device includes a flat elongated display panel having a front surface with indicia and a back surface with an adjustable connection. The adjustable connection comprises a round male projection integrated and extending from the back surface of the flat elongated display panel. A compressible female retaining member having a concave internal recess is provided to receive and secure the projection within the concave internal recess. A nut fastener is adapted to receive the projection from a first side. The female retaining member is received from an opposite second side of the nut fastener. As the nut fastener is threaded and tightened against the female retaining member, the female retaining member is compressed over the projection to secure the projection within the female retaining member. A flexible arm having a first end is attached to the female retaining member and a second end of the flexible arm is attached to a suction cup fastener.

The display device may be designed to include an illumination source, such as LED's or other suitable light source to prominently display the indicia.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures.

FIG. 6 is a perspective view of the retaining member.

FIG. 7 is a side view of the retaining member.

FIG. 8 is a front view of the retaining member.

DETAILED DESCRIPTION OF EXEMPLARY EMBODIMENTS

Particular embodiments of the present invention will now be described in greater detail with reference to the interior rearview mirror devices 10, 100 shown in the attached figures. The objects and features of the invention are interchangeable and applicable to the various embodiments of the interior rearview mirror devices 10 described herein.

Figure 1:
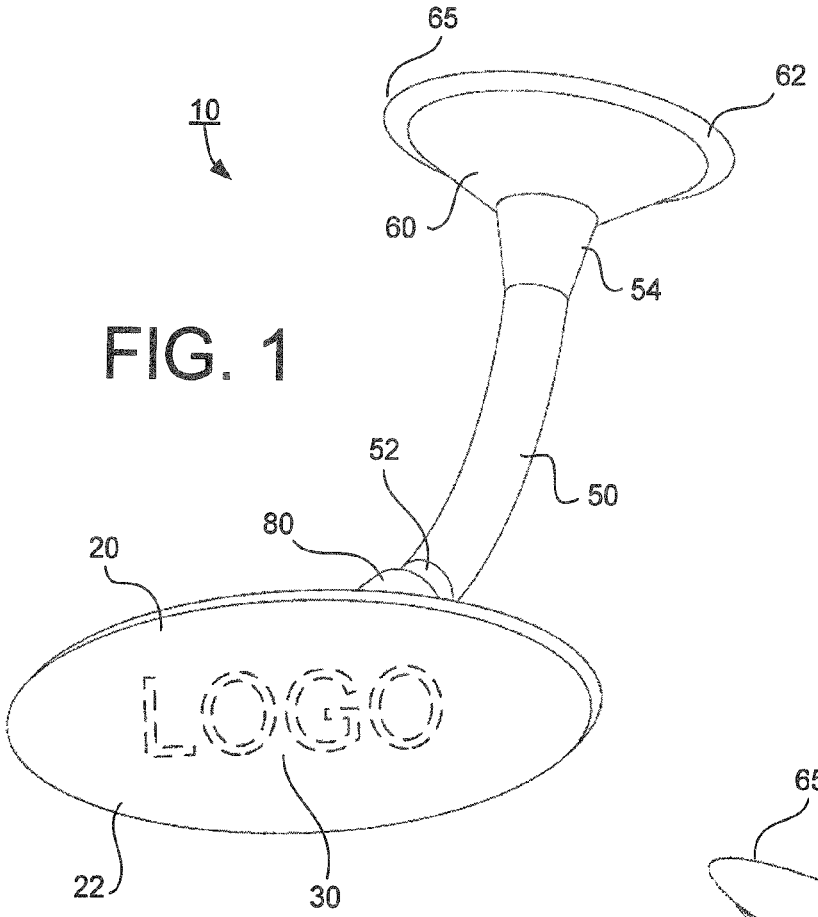
FIG. 1 is a front perspective view of the display device according to this invention.
Figure 2:
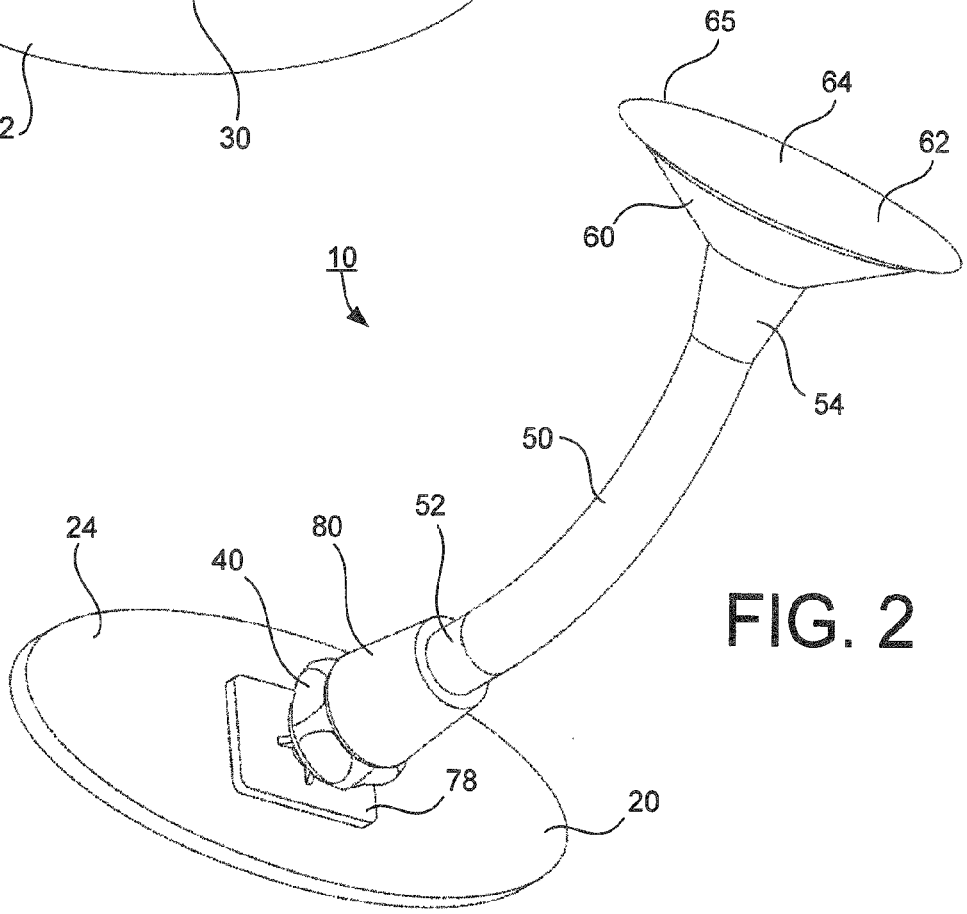
FIG. 2 is a rear perspective view of the display device.

FIGS. 1-2 illustrate perspective front and rear views of a display device 10. The display device 10 includes a flat elongated display panel 20 having a front surface 22 and a rear surface 24. The display panel 20 may take a variety of different shapes, sizes, colors or the like as contemplated within the features and objects of this subject disclosure.

The front surface 22 includes indicia 30 displayed thereon. A fastener 40 is adapted to secure display panel 20 to a flexible arm 50. The flexible arm 50 includes a first end 52 attached to the fastener 40 and a second end 54 attached to a suction cup 60.

Figure 3:
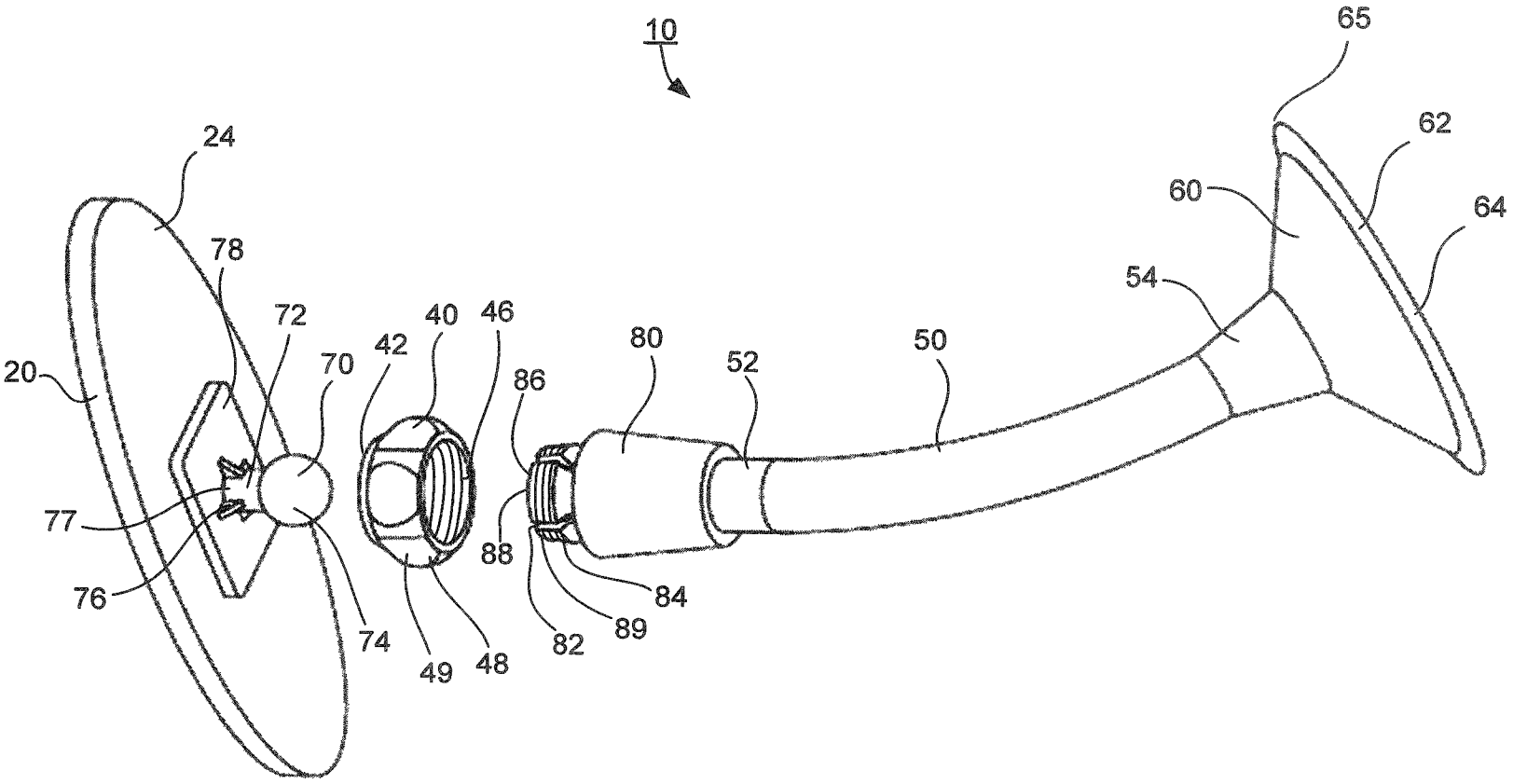
FIG. 3 is an exploded perspective view of the display device.
Figure 4:
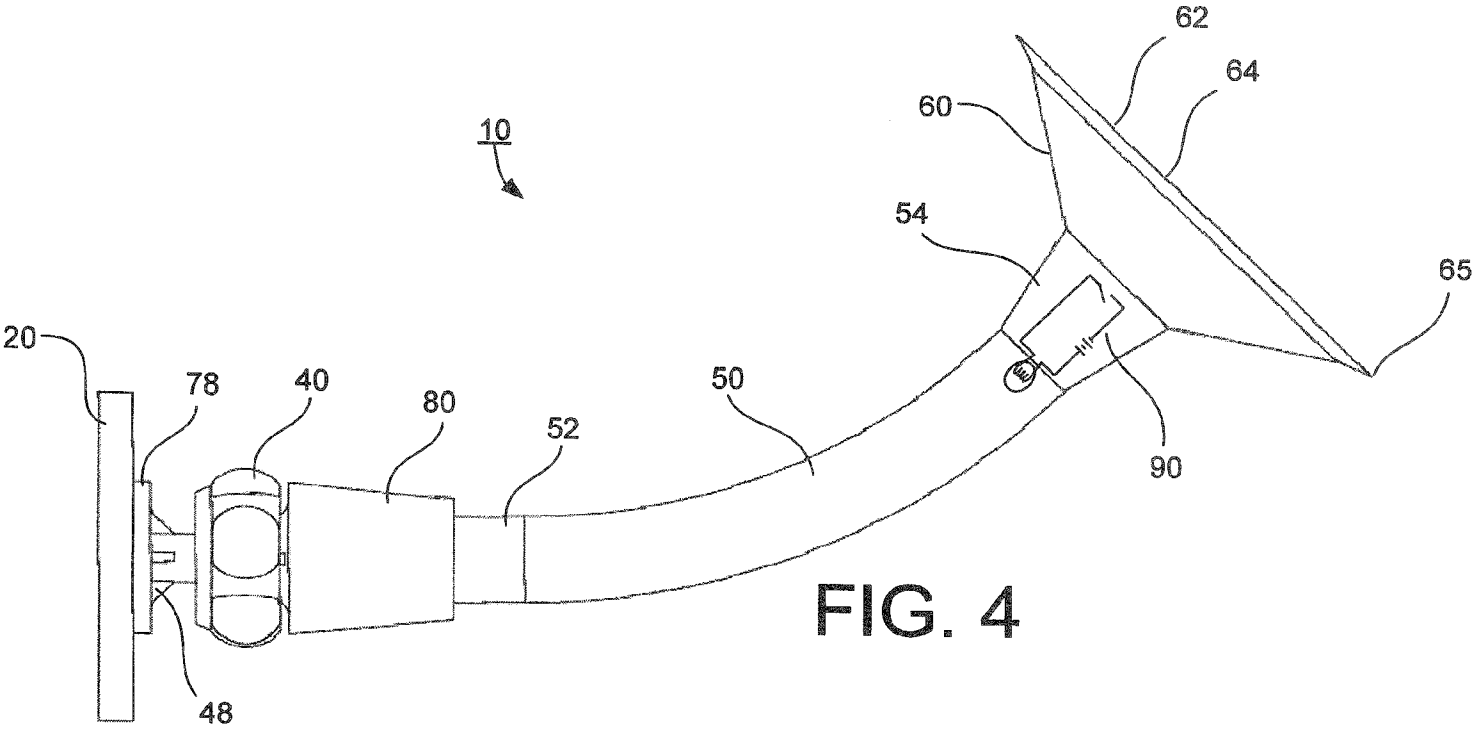
FIG. 4 is a side view of the display device.
Figure 5:
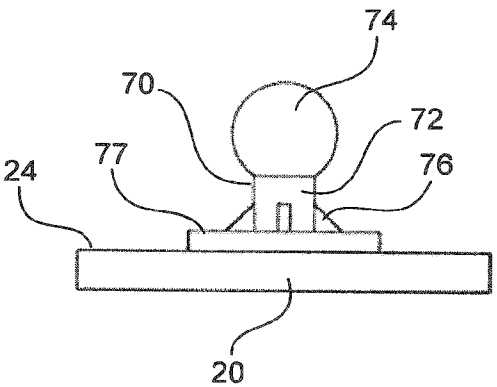
FIG. 5 is an enlarged view of the projection extending from the display panel.

FIGS. 3-5 show an exploded view, an assembled view and an exploded view of the projection 70 of the display device 10. As shown in FIG. 5, a projection 70 is permanently and fixedly integrated onto the rear surface 24 of the elongated display panel 20. The projection 70 includes a post 72 and a round end 74. The post 72 may include ribs 76 disposed adjacent to and around the post 72 at the base 77 of the projection 70 to provide enhanced structural rigidity to the projection 70. The base 77 of the post 72 may be a plate or other shape, which in turn is permanently integrated and/or fastened to the rear surface 24 of the display panel 20.

FIGS. 6-8 depict various views from different angles of the retaining member 80. The retaining member 80 is provided at a first end 52 of the flexible arm 50. The retaining member 80 is a female component adapted to receive the male round end 74 of the projection 70. As shown in FIG. 7 from the inward bend 83 of the outer surface of the retaining member 80, an inner surface 82 of the retaining member 80 contains an inward rounded internal shape adapted to receive and mate with the outer surface of the rounded end 74 of the projection 70. That is, the retaining member 80 has a concave internal recess 82 adapted to receive the rounded end 74 of the projection 70 within the concave internal recess 82 of the retaining member 80.

An outer first end 88 of the retaining member 80 may include a slight inward lip construction adapted to promote the slip fit connection such that the connection between the rounded end 74 of the projection 70 and the concave internal recess 82 are slightly interfered with when the rounded end 74 of the projection 70 is placed into the concave internal recess 82 of the retaining member 80. The retaining member 80 includes various external threads 84 disposed on an outer surface 86 of the retaining member 80.

FIG. 6 shows various axial slots 89 extending from the first end 88 inward to a predetermined distance dividing the retaining member 80 into various flexible sections 81. The various flexible sections 81 (four sections shown) disposed around the first end 88 can be flexed in an inward compressed direction when the fastener 40 is tightened over its external threads 84.

Figure 9:
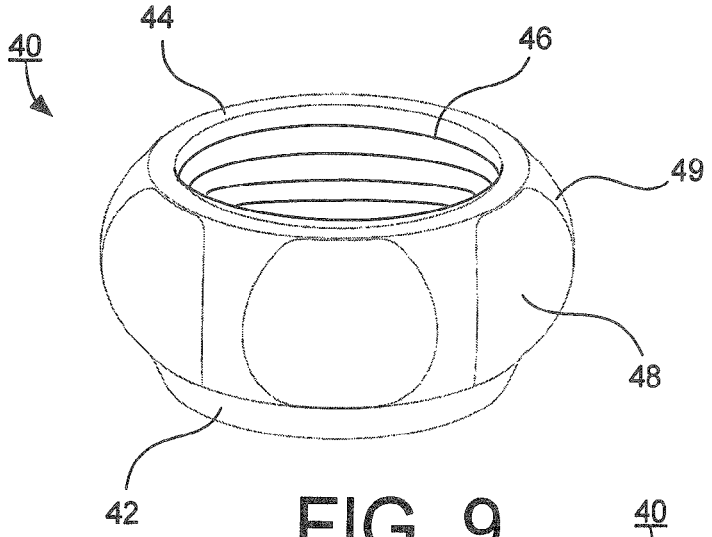
FIG. 9 is an upper perspective view of the fastener.
Figure 10:
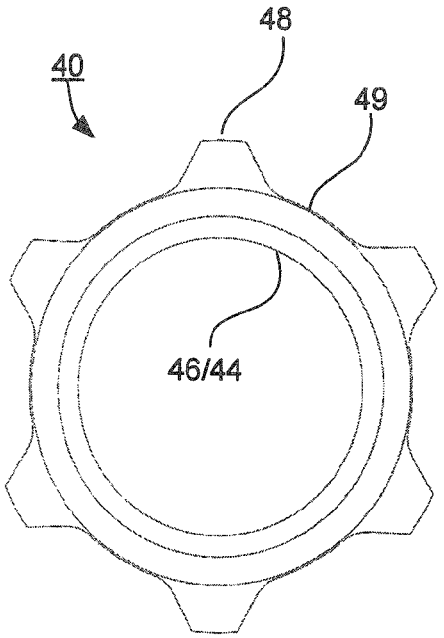
FIG. 10 is a front view of the fastener.
Figure 11:
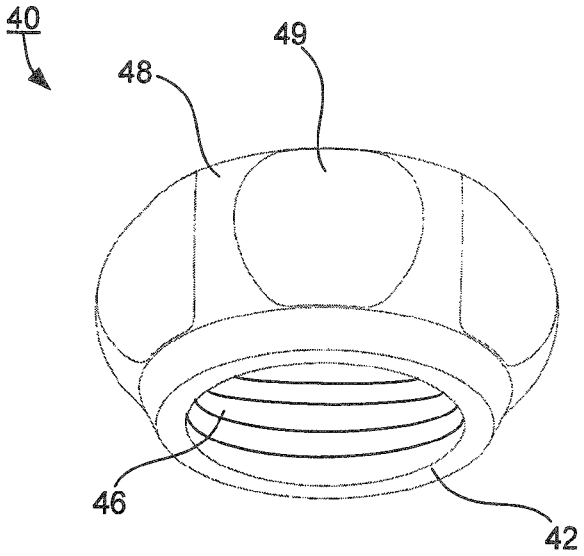
FIG. 11 is a lower perspective view of the fastener.

FIGS. 9-11 depict the fastener 40 in a variety of different views. As shown, the fastener 40 is depicted as a nut-type fastener that includes various threads 44 disposed on an inner surface 46 of the fastener 40. The fastener 40 may include a plurality of protruding webs 48 extending from an outer surface 49 of the cylindrical fastener 40. The webs 48 are provided to allow a user to conveniently grip onto the outer surface 49 of the assembly 40.

As shown exploded in FIG. 3 and assembled for use in FIG. 4, the fastener 40 is placed over the round end 74 of the projection 70 and the first end 88 of the retaining member 80. That is, the rounded end 74 of the projection 70 is inserted into a first end 42 of the fastener 40 and the retaining member 80 is inserted into a second end 44 of the fastener 40 until the round end 74 of the projection 70 is inserted into the internal recess 82 of the retaining member 80. In particular, the rounded end 74 of the projection 70 is slip fit into a first end 88 of retaining member 80 until the rounded end 70 is located within the concave internal recess 82 of the retaining member 80. The internal threads 44 of the fastener 40 are threadedly fastened to the external threads 84 of the retaining member 80.

As the fastener 40 is tightened over the external threads 84 of the retaining member 80, the outer split ends 89 of the retaining member 80 provided at the first end 88 are flexibly compressed onto the rounded end 74 of the projection 70. As the fastener 40 is threadedly tightened onto the external threads 84 on the retaining member 80, the rounded end 74 of the projection is pulled deeper into the concave inner internal recess 82 of the retaining member 80 until it is locked tightly within the internal recess 82 of the retaining member 80.

The fastener 40 may be selected from any number of fastening mechanisms, including but not limited to, a screw, a universal joint, a releasable locking pin, a ratchet and teeth mechanism, a pivot, a telescopic extension, a swivel, a universal joint, and/or any other suitable fastening mechanism desired for optimal positioning of the display panel 20 in any preferred orientation.

Likewise, the display panel can be positioned in a variety of different positions due to the mobility and/or flexibility provided between the round end 74 of the projection 70 and the retaining member 80. Likewise, additional flexibility is provided by the mobility in the flexible arm 50 which will allow the display panel 20 to move in a variety of different positions.

Referring back to FIGS. 1-4, the suction cup 60 is provided at the second end 54 of the flexible arm 50 and can leverage the use of various types of suction cups to generate a partial vacuum or negative fluid pressure of air or similar fluid to adhere to a substantially nonporous surface. Generally, the working surface 62 of the suction cup 60 has a curved surface, as shown in FIG. 2. When the center of the suction 60 cup is pressed against a flat, substantially non-porous surface, the volume of the space between the suction cup 60 and the flat surface is reduced, which causes the fluid between the circular cup 64 and the surface to be expelled past a rim 65 of the circular cup 64. When a physical pressure being applied to the circular cup 64 is ceased, the elastic substance of which the cup 64 is made tends to resume its original, curved shape. Because most of the fluid has already been forced out of the inside of the cup 64, a cavity which tends to develop between the cup 64 and the flat surface has little to no air or water in it, and therefore lacks pressure. This pressure difference between the atmosphere on the outside of the cup 64, and the low-pressure cavity on the inside of the cup 64, is what keeps the cup 64 adhered to the surface. The length of time for which the suction effect is maintained is dependent on how long it takes for fluid (air) to leak back into the cavity between the cup 64 and the surface, thereby equalizing the pressure within the cavity with the surrounding atmosphere. This depends on the porosity and flatness of the surface and the rim of the cup. Various other types of suction cups may be applied such as a cup lifter mechanism in which the cup portion of the suction cup is mechanically lifted to increase the vacuum pressure in the cavity under the cup to increase the suction hold force generated by the suction cup.

Various materials may be used as the composition for the display device 10. For example, a metal, a polymer, a rubber, a plastic, a vinyl, cloth, a moldable material, a paper product and/or any other material, now known or later discovered, may be used to make up the composition of the display device. The various components of the display device 10 may be translucent, opaque and/or any other shade, texture or color therefore.

The indicia 30 on the display panel 20 may be composed of a variety of different shapes, colors and sizes. FIGS. 1-4 show the display panel 20 and the indicia 30 being constructed oval and oblong in configuration. However, it is to be understood that any size and shape (for example, a star shape display panel 20 including indicia 30) may be chosen according to this subject disclosure. The indicia 30 and/or the display panel 20 may take any desired shape, including but not limited to, circles, rectangles, squares, triangles, trademark designs, a logo, a brand, a mascot, and/or any obtuse shape, design or printed indicia in accordance with this invention.

The display panel 20 may be opaque and/or may be made of a translucent material to display the indicia 30 therethrough. The indicia 30 may be affixed onto the display panel 20 in a variety of different ways. For example, the indicia 30 may be silk-screened or formed directly into the display panel 20 in any number of plausible ways now known or later developed. Alternatively, the indicia 30 may be embedded within a translucent display panel. The indicia 30 may include, for example, a trademark, a service mark, a name, an emblem, a logo, a banner, an advertisement and/or any other type of indicia. The user can place indicia 30 to support their favorite business, university, school, local establishment, military, hobbies, and the like.

The indicia 30 may be attached to display panel 30 in a variety of different ways. One method would be to provide an adhesive to the back side of the indicia 30 that lies adjacent to the display panel 20. The adhesive may be glue, a polymer, rubber, cement, a translucent adhesive, Velcro, and/or any other type of material used for providing adhesion from one surface to another within the scope of this invention.

An illumination source may be provided throughout various component parts of the display device 10. The illumination source can be beneficial to enhance the visibility of the indicia 30 and/or any other component part of the display device 10. FIG. 4 shows an exemplary illumination circuit diagram 90 partially disposed in the flexible arm 50 of the display device 10. Although shown located in the second end of the flexible arm 50, the illumination circuit diagram 90 and source (such as a light emitting diode(s) (LED)) may be integrated within any of the various components within the display device 10. For example, the light emitting diode (LED's) can be positioned within the display device 20 leading from the suction cup 60, through the flexible arm 50 and into the display panel 20 to illuminate the indicia 30. All along that path, any component part of the display device may be illuminated together or separable.

The fiber optic elements in the display device 20 may be electrically connected through various wire conductor elements to a replaceable power source, such as a battery. Alternatively, the display device itself may have solar collecting elements adapted to collect and store the solar energy stored for later use when the display device 10 is placed in a dark environment.

Various electrical connections may be made through the various component parts of the display device 10 via various conductive junctions such that each of the illumination component parts can be electrically connected closing a circuit causing each to transfer power from a power source to each of the illumination component parts of the display device 10.

The power source may be activated by a switching element such that illumination of the fiber optic elements within the display device 10 can be activated upon activation of the switching element, or performs some desired action, such as by depressing a button on the display device 10.

The display device 10 may be embedded with an access element may that contains various types of information capable of providing verification, authentication and access that are currently known or later developed. For example, the access element may be a magnetic strip, a bar code, a near field technology element, an RF transponder, and/or any other method for sending and receiving information to and from a processor in an electronic control unit and the access element.

The access element may be disposed anywhere on the display device 10. The access element may be implemented for any number of various purposes. For example, at an athletic sporting event, the display device 10 with the access element may provide entry to the event or the parking lot to the event on the particular day that the event is scheduled. After the event has concluded, access to the event parking lot may be disabled and the display device 10 may be used as a display memento in support of the particular team displayed by the indicia 30 on the display device 10.

Alternatively, the display device 10 with the access element may be programmed as a season parking pass which will enable access throughout an entire sporting event season or the like. It would only then be necessary to provide one access element as a season pass and not a parking pass and an event ticket for entrance for each game day. Security personnel can verify proper access to the event by swiping a reader over the display device 10 embedded with the access element and reading and verifying proper admittance for that particular day.

In addition, if an RF transponder or near field technology element is integrated as the access element, an arm to the parking lot gate may be opened only if access for that particular day could be verified and approved by an RF receiving device attached to a processor.

According to this invention, the processor may be implemented at various elements of the display device 10. The processor may be implemented in association with, and/or as part of, the various access technologies used for authenticating and granting access to the access element, and/or in association with the various elements of the display device 10. The processor may be implemented as a programmed general purpose computer, on a special purpose computer, a programmed microprocessor or micro-controller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device processor capable of providing the information necessary to provide access information can be used according to this subject disclosure.

The processor may be associated with a storage unit (not shown) using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a write-able or rewrite-able optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

The processor of the display device 10 is programmable and can be adapted to provide instructions for access limitations to a particular area in accordance with this subject disclosure.

According to another alternative, a portion of the housing of the display device 10 may include a storage compartment for an air freshener. The housing may include various perforations through which the odor may escape from within the housing of the display device 10. The air freshener may be used to sanitize the air, neutralize odor, or simply refresh the surrounding area of an undesirable order. The air freshener may be employed with a dual purpose for eliminating the source of an odor while leaving a clean scent in its place. The air fresheners may be embodied as a fragrance that permits a predetermined amount of fragrance to emanate through the various perforations. Alternatively, and not shown, the air freshener may be dispensed as a spray or a puff of fragrance in which a push-button mechanism integrated onto the display device 10 may cause the air freshener to be dispensed through the various perforations.

Various types of aromatic fragrance materials may be used in combination with this invention and placed within the air freshener housing, including, but not limited to, scented, materials, waxy materials, potpourri, gels, a variety of synthetic fragrance components, such as aldehydes, ketones, esters, alcohol, terpenes, and any other fragrance that is now known or later developed in accordance with this invention. Alternatively, the display device 10 housing may be made of an air freshening material.

It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A display device comprising:

an elongated display panel having a front surface and a back surface, the front surface including indicia displayed thereon;

a projection having a round end and a flat base attached to the back surface of the elongated display panel;

a retaining member having external threads and an internal recess adapted to receive and secure the projection within the internal recess;

a cylindrical fastener having internal threads, the cylindrical fastener is adapted to receive the projection from a first side and the retaining member from a second side, wherein when the cylindrical fastener is threaded in a tightening direction onto the retaining member the retaining member is compressed over the first round end of the projection to secure the projection within the internal recess of the retaining member; and a flexible arm having a first end attached to the retaining member and a second end attached to a suction cup fastener, and wherein the display device includes air deodorizer.

2. The display device recited in claim 1, wherein the flat base is permanently attached to the back surface of the display panel.

3. The display device recited in claim 1, wherein the elongated display panel is radially adjustable via a connection made between the round end of the projection and the internal recess of the retaining member.

4. The display device recited in claim 1, wherein a first end of the retaining member is a compressible element that includes relief axial perforations extending from the first end of the retaining member.

5. The display device recited in claim 1, wherein the arm is radially flexible and adapted to provide radial positioning relative to the second end attached to a surface by the suction cup fastener.

6. The display device recited in claim 1, wherein at least one of the display device and the flex arm includes an illumination source.

7. The display device recited in claim 1, wherein the display device includes an electronic access element.

8. A display device comprising:

a flat elongated display panel having a front surface and a back surface, the front surface including indicia displayed thereon;

a round male projection integrated and extending from the back surface of the flat elongated display panel;

a compressible female retaining member having a concave internal recess adapted to receive the projection within the concave internal recess;

a nut fastener adapted to receive the projection from a first side and the female retaining member from a second side, wherein when the nut fastener is threaded in a tightening direction the compressible female retaining member is compressed over the projection to secure the projection within the concave internal recess of the female retaining member;

a suction cup; and a flexible arm having a first end attached to the female retaining member and a second end attached to the suction cup fastener, and wherein the display device includes air deodorizer.

9. The display device recited in claim 8, wherein the round male projection includes a flat base that is permanently attached to the back surface of the display panel.

10. The display device recited in claim 8, wherein the flat elongated display panel is radially adjustable via a connection made between the round end of the projection and the internal recess of the retaining member.

11. The display device recited in claim 8, wherein a first end of the retaining member is a compressible element that includes axial perforations extending from the first end of the retaining member.

12. The display device recited in claim 8, wherein at least one of the display device and the flex arm includes an illumination source.

13. A display device comprising:

a display panel having a front surface and a back surface, the front surface including indicia displayed thereon;

a projection having a round end and a flat base attached to the back surface of the elongated display panel;

a retaining member having external threads and an internal recess adapted to receive and secure the projection within the internal recess;

a fastener having internal threads, the fastener being adapted to receive the projection from a first side and the retaining member from a second side, wherein when the fastener is threaded in a tightening direction onto the retaining member, the retaining member is compressed over the round end of the projection to secure the projection within the retaining member; and a flexible arm having a first end attached to the retaining member and a second end attached to a suction cup fastener, and wherein the display device includes air deodorizer.

14. The display device recited in claim 13, wherein the flat base of the projection is permanently attached to the back surface of the display panel.

15. The display device recited in claim 13, wherein the elongated display panel is radially adjustable via a connection made between the round end of the projection and the internal recess of the retaining member.

16. The display device recited in claim 13, wherein a first end of the retaining member is a compressible element that includes relief axial perforations extending from the first end of the retaining member.

17. The display device recited in claim 13, wherein at least one of the display device and the flex arm includes an illumination source.

* * * * *